US008828263B2

(12) United States Patent
Forehand et al.

(10) Patent No.: US 8,828,263 B2
(45) Date of Patent: Sep. 9, 2014

(54) HIGH DURABILITY MAGNETORHEOLOGICAL FLUIDS

(75) Inventors: Teresa L. Forehand, Raleigh, NC (US); Daniel E. Barber, Fuquay-Varina, NC (US)

(73) Assignee: LORD Corporation, Cary, NC (US)

( * ) Notice: Subject to any disclaimer, the term of this patent is extended or adjusted under 35 U.S.C. 154(b) by 98 days.

(21) Appl. No.: 13/263,763

(22) PCT Filed: May 28, 2010

(86) PCT No.: PCT/US2010/036513

§ 371 (c)(1),
(2), (4) Date: Oct. 10, 2011

(87) PCT Pub. No.: WO2010/141336

PCT Pub. Date: Dec. 9, 2010

(65) Prior Publication Data

US 2012/0074348 A1 Mar. 29, 2012

Related U.S. Application Data

(60) Provisional application No. 61/182,773, filed on Jun. 1, 2009.

(51) Int. Cl.
*H01F 1/44* (2006.01)

(52) U.S. Cl.
CPC ..... *H01F 1/442* (2013.01); *H01F 1/445* (2013.01)
USPC ..... 252/62.52; 252/62.55

(58) Field of Classification Search
USPC ..... 252/62.55, 62.52
See application file for complete search history.

(56) References Cited

U.S. PATENT DOCUMENTS

| | | | | |
|---|---|---|---|---|
| 4,992,190 | A | 2/1991 | Shtarkman | |
| 5,505,880 | A | 4/1996 | Kormann et al. | |
| 5,523,157 | A | 6/1996 | Sasaki et al. | |
| 5,667,715 | A | 9/1997 | Foister | |
| 6,599,439 | B2 * | 7/2003 | Iyengar et al. | 252/62.52 |
| 6,692,650 | B2 | 2/2004 | Park et al. | |
| 6,818,143 | B2 | 11/2004 | Iyengar | |
| 2001/0032961 | A1 | 10/2001 | Iyengar | |
| 2001/0045540 | A1 | 11/2001 | Iyengar | |
| 2003/0042461 | A1 | 3/2003 | Ulicny et al. | |
| 2003/0209687 | A1 | 11/2003 | Iyengar | |
| 2004/0084651 | A1 | 5/2004 | Kintz et al. | |
| 2006/0097232 | A1 | 5/2006 | Hakata et al. | |
| 2007/0210274 | A1 | 9/2007 | Bose et al. | |
| 2008/0296530 | A1 | 12/2008 | Fuchs et al. | |
| 2008/0312110 | A1 | 12/2008 | Barber et al. | |
| 2009/0014681 | A1 | 1/2009 | Iyengar et al. | |
| 2009/0289214 | A1 | 11/2009 | Kieburg et al. | |

FOREIGN PATENT DOCUMENTS

| | | | |
|---|---|---|---|
| CN | 101136278 | | 3/2008 |
| EP | 0 313 063 | | 4/1989 |
| JP | H01208726 | A | 8/1989 |
| JP | H1032114 | A | 2/1998 |
| JP | 2005501959 | A | 1/2005 |
| JP | 2006505957 | A | 2/2006 |
| SU | 1154938 | A1 | 4/1996 |
| WO | 93/21644 | | 10/1993 |
| WO | 95/28719 | | 10/1995 |
| WO | 01/03150 | | 1/2001 |
| WO | 2008/055645 | | 5/2008 |

* cited by examiner

*Primary Examiner* — Carol M Koslow
(74) *Attorney, Agent, or Firm* — Todd W. Galinski

(57) ABSTRACT

A magnetorheological fluid comprising a mixture of soft and hard iron particles, an organic based carrier fluid, and optional additives such as anti-friction, anti-wear, or surfactants unexpectedly have improved durability when used in devices for control vibration and/or noise, for example, shock absorbers, elastomeric mounts, dampers, and the like.

16 Claims, No Drawings

HIGH DURABILITY MAGNETORHEOLOGICAL FLUIDS

CROSS REFERENCE

This patent application claims the benefit and priority of U.S. provisional application 61/182,773, filed Jun. 1, 2009 for HIGH DURABILITY MAGNETORHEOLOGICAL FLUIDS, which is hereby fully incorporated by reference.

FIELD OF THE INVENTION

The present invention relates to magnetorheological fluid compositions that have improved durability. More specifically, the present invention relates to magnetorheological fluid compositions containing mixtures of relatively hard particles and relatively soft particles with iron particles being preferred.

BACKGROUND OF THE INVENTION

Magnetorheological fluids are magnetic field responsive fluids containing a field polarizable particle component and a liquid carrier component. Magnetorheological fluids are useful in devices or systems for controlling vibration and/or noise. Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

The particle component compositions typically include micron-sized magnetic-responsive particles. In the presence of a magnetic field, the magnetic-responsive particles become polarized and are thereby organized into chains of particles or particle fibrils. The particle chains increase the apparent viscosity (flow resistance) of the fluid, resulting in the development of a solid mass having a yield stress that must be exceeded to induce onset of flow of the magnetorheological fluid. The particles return to an unorganized state when the magnetic field is removed, which lowers the viscosity of the fluid.

Magnetorheological (MR) fluids are comprised of small spherical ferromagnetic or paramagnetic particles dispersed within a carrier fluid. Small magnetic particle size permits easy suspension and the design of devices having small gaps. Standard carbonyl iron (CI), a commonly used iron, is derived from iron pentacarbonyl vapor by a gas-phase decomposition process, resulting in a spherical particle with a relatively high carbon content. Reduced CI, prepared by reduction of standard CI and having very low carbon content, can also be used. However, standard and reduced CI are somewhat expensive compared to other iron types. Moreover, the use of carbonyl iron limits the range of metallurgy that can be used due to the process used to obtain such CI particles.

Development of lower-cost MR fluids for use in primary automotive suspension dampers has been an ongoing effort for several years. The main focus has been to use lower-cost water-atomized iron (WAI) particles to replace the current higher-cost carbonyl iron (CI) used in prior art fluids. The production of WAI particles is known to the art and to the literature and generally relates to melting iron or an iron alloy, allowing it to flow from a small orifice to form a thin stream, and subjecting the molten stream to high-pressure water spray to form metal particles. Much effort has been devoted to determining whether larger water-atomized iron (WAI) powder can meet durability requirements, with little success to date. Simply substituting larger WAI for CI in an MR fluid specially formulated for good durability produced a fluid with unacceptable durability. Attempts to optimize the MR fluid formulation with larger WAI were not successful.

The root cause of durability failure in fluids with larger WAI is degradation of the iron powder through mechanical working such that a large amount of fine particles (less than 1 micron diameter) are produced.

It would therefore be desirable to provide a magnetorheological (MR) fluid employing water-atomized particles which meet durability criteria and produce fewer degraded fine particles after periods of mechanical working.

SUMMARY OF THE INVENTION

In an embodiment of the present invention, a magnetorheological fluid is provided comprising a carrier fluid and a blend of relatively soft water-atomized iron particles or powder with a small amount of a relatively hard particle or powder. In another embodiment of the present invention, a MR fluid formulation is provided further comprising a hydrocarbon oil as a carrier fluid and optional thickeners and other additives typical of MR fluids.

Though the invention has particular utility when replacing carbonyl iron with water atomized iron, it is within the scope of an embodiment of the present invention that either one or both sets of iron particles comprise carbonyl iron.

In another embodiment of the present invention, an MR fluid is provided comprising a hydrophobic carrier oil, a suspension aid, and a mixture of a softer water-atomized iron powder with a small or minor amount of a significantly harder metal powder such as iron. Other additives known in the art and literature may also be added, including surfactants and other additives to reduce wear and friction and to improve oxidation resistance.

The MR fluids containing a mixture of different hardness particles or powders unexpectedly provide durability and device wear characteristics that are superior to MR fluids utilizing only soft water-atomized iron powder. The use of various additives also improved durability.

In one aspect of the invention a magnetorheological fluid is disclosed comprising a blend of two classes of magnetically responsive particles wherein one class is relatively hard and has a mean diameter particle range of about 1 micron to about 150 microns and the other class is relatively soft and has a mean diameter particle range of about 1 micron to about 100 microns, and wherein said fluid is free of fluorocarbons.

In another aspect of the invention is a method for forming a magnetorheological fluid, comprising the step of: blending hard magnetically responsive particles and soft magnetically responsive particles with a carrier fluid, said magnetorheological fluid being free of fluorocarbons, wherein said hard particles have a mean diameter particle range of 1 micron to 150 microns and the soft particles have a mean diameter particle range of 1 micron to 100 microns.

DETAILED DESCRIPTION OF THE INVENTION

The magnetic-responsive particles or powder utilized in the present invention can be any solid known to exhibit magnetorheological activity. Typical particle components useful in the present invention are comprised of, for example, paramagnetic, superparamagnetic or ferromagnetic compounds. Specific examples of magnetic-responsive particles which may be used include particles comprised of materials such as iron, iron alloys, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrite and magnetite. In addition, the magnetic-responsive particle component can be comprised of any of the known alloys of iron, such as those containing aluminum, silicon, cobalt, nickel, vanadium, molybdenum, chromium, tungsten, and/or copper. However, carbonyl iron is not preferred and thus can be excluded (i.e. free of) from the present invention. That is, any amount thereof in a composition of the present invention is less than 10%, desirably less than 5% or less than 2% by weight, or none, based upon the total weight of all iron particles.

Iron alloys that can be used as the magnetic-responsive particles in the present invention include iron-cobalt and iron-nickel alloys. The iron-cobalt alloys preferred for use in the magnetorheological compositions have an iron:cobalt weight ratio ranging from about 30:70 to about 95:5, and preferably from about 50:50 to about 85:15, while the iron-nickel alloys have an iron-nickel weight ratio ranging from about 90:10 to about 99:1, and preferably from about 94:6 to about 97:3. The iron alloys can contain a small amount of other elements, such as vanadium, chromium, etc., in order to improve the ductility and mechanical properties of the alloys. These other elements are typically present in an amount that is less than about 3.0% by weight.

In a preferred embodiment of the present invention, magnetic-responsive soft particles are utilized that have an iron content of from about 97.0 to about 99.9 weight percent, desirably from about 98 to about 99.5 weight percent, and preferably from about 98.5 to about 99.5 weight percent. The amount of carbon therein is generally less than 0.05 and preferably less than about 0.02 weight percent. The preferred soft iron particles of the present invention also contain low amounts of chromium and boron. For example, the amount of chromium is generally from about 0 to about 2 weight percent and preferably from about 0.1 to about 1.5 weight percent. The amount of the boron generally ranges from about 0 to about 2 weight percent and preferably from about 0.1 to about 0.9 weight percent.

The morphology of the softer iron particles is substantially round with a relatively smooth surface, as judged from SEM photographs. The mean diameter of the softer iron powder can be within the typical range for MR fluids, namely about 1 or about 5 to about 100 microns and preferably from about 2 to about 8 microns. The hardness of the softer powder is typically less than about 400 $H_v$ (Vickers hardness), and desirably from about 50 to about 300 $H_v$, as measured by microindentation.

The harder iron particles of the present invention also have a high iron content, generally from about 85 to about 95 weight percent and desirably from about 88 to about 96 weight percent. The amount of carbon therein is generally from about 0 to about 1.0 weight percent and preferably from about 0.01 to about 0.8 weight percent. The hard iron particles generally contain from about 0 to about 3 weight percent and preferably from about 0 or 0.1 to about 2.5 weight percent chromium. The amount of boron therein is generally from about 0 to about 4.0 weight percent and preferably from about 2.0 to about 3.5 weight percent. The amount of silicon ranges from about 0.5 to about 7.0 weight percent and preferably from about 1.0 to about 4.0 weight percent.

The morphology of the harder particles or powder should be nearly spherical with a smooth surface. The harder particles should have a mean diameter particle size equal to or slightly greater than that of the softer iron powder for best effect, i.e. 1.0 to about 1.3 times larger. Suitable particles sizes generally range from about 1 or about 3 microns or about 5 to about 150 microns, and desirably from about 1 or about 2 to about 10 microns. The hardness of the harder particles should be comparable to the hardness of the metal of the device in which it is used. Suitable Vickers hardness for the harder particles is from about 550 to about 1100 $H_v$, desirably from about 600 to about 1050 $H_v$.

In an embodiment of the present invention, the amount of the harder iron particles should be less than about 20% and more than about 5% by weight of the total iron particle content, i.e. total weight of the hard particles and soft particles, with the ranges dependent upon the specific mechanical properties of the device in which the fluid is used. A general range of the amount of hard iron particles is from about 5% to about 50% by weight, desirably from about 5% or 8% to about 30% or about 40% by weight, and preferably from about 10% to about 20% by weight based upon the total weight of the one or more harder iron particles and the one or more softer iron particles that are utilized in the MR fluid. That said, the soft iron particles are present in an amount from about 50% to about 95% by weight, desirably from about 60% or about 70% to about 92% or about 95% by weight, and preferably from about 80% to about 90% by weight based upon the total weight of the one or more hard iron particles and the one or more soft iron particles. Mixtures with more than about 20% of the harder iron particles may be too abrasive to the device, and mixtures with less than about 5% may not show the desired durability improvement.

Iron particles produced via a water atomization process are preferred for both the soft and hard iron particles.

The iron particles of the present invention are not coated, i.e. they are free of any coating such as a polyelectrolyte, a hydrophilic surfactant, etc., since they are readily dispersible in the MR fluid. That is, if any polyelectrolyte or hydrophilic surfactant is utilized it is in small amounts, such as generally from about 0.5 parts by weight or less, desirably from about 0.3 parts by weight or less, and preferably no hydrophilic surfactant is utilized for 100 parts by weight of the MR fluid.

The carrier fluid used to form a magnetorheological fluid of the present invention can generally be any carrier fluids known to the literature and to the art.

In a preferred embodiment, the carrier fluid is an organic fluid, or an oil-based fluid, i.e. a hydrophobic fluid. Suitable carrier fluids that can be used include natural fatty oils, mineral oils, polyphenylethers, dibasic acid esters, neopentylpolyol esters, phosphate esters, synthetic cycloparaffins and synthetic paraffins, synthetic unsaturated hydrocarbon oils, monobasic acid esters, glycol esters and ethers, silicate esters, silicone oils, silicone copolymers, synthetic hydrocarbons, and mixtures or blends thereof. Examples of other suitable fluids include silicone oils, silicone copolymers, white oils, hydraulic oils, and transformer oils. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. The carrier fluids utilized in the present invention can be prepared by methods well known in the art and many are commercially available, such as Durasyn® PAO and Chevron Synfluid PAO. Various gels such as silica gels are avoided because they can be too abrasive in the device.

The total amount of the one or more soft iron particles and of the one or more hard iron particles utilized is from about 50 to about 90 parts by weight and preferably from about 60 to about 89 parts by weight based upon 100 total parts by weight of the carrier fluid.

The MR fluids of the present invention can contain various additives known to the art and to the literature such as anti-friction agents, anti-wear agents, extreme pressure agents, anti-oxidant agents, various surfactants, thixotropes, viscosity modifiers, and the like. Depending upon desired end uses, the amount of each type of agent can vary such as from about 0.1 to about 3 parts by weight based upon 100 total parts by weight of the MR fluid. The total amount of all such additives is desirably from about 1 to about 5 parts by weight and preferably from about 2 to about 4 parts by weight per 100 total parts by weight of the MR fluid.

However, it is not an aspect of the present invention to use a fluorocarbon grease to provide anti-settling characteristics to the MR fluid since the above described invention does not have anti-settling problems. Thus, the present invention is free of any fluorocarbon greases, that is, contains less than about 0.01 parts by weight of desirably less 0.005 parts by weight and preferably no parts by weight of any fluorocarbon grease per 100 parts by weight of MR fluid.

Of the various additives, particularly suitable additives are an organomolybdenum additive, an organothiophosphorus additive, or a combination of the two additives. Suitable organomolybdenum additives can be a compound or complex whose structure includes at least one molybdenum atom bonded to or coordinated with at least one organic moiety. The organic moiety can be, for example, derived from a saturated or unsaturated hydrocarbon such as alkane, or cycloalkane; an aromatic hydrocarbon such as phenol or thiophenol; an oxygen-containing compound such as carboxylic acid or anhydride, ester, ether, keto or alcohol; a nitrogen-containing compound such as amidine, amine or imine; or a compound containing more than one functional group such as thiocarboxylic acid, imidic acid, thiol, amide, imide, alkoxy or hydroxy amine, and amino-thiol-alcohol. The precursor for the organic moiety can be a monomeric compound, an oligomer or polymer. A heteroatom such as ═O, —S, ═N also can be bonded to or coordinated with the molybdenum atom in addition to the organic moiety.

A particularly preferred group of organomolybdenums is described in U.S. Pat. No. 4,889,647 and U.S. Pat. No. 5,412,130, with the latter describing heterocyclic organomolybdates that are prepared by reacting diol, diamino-thiol-alcohol and amino-alcohol compounds with a molybdenum source in the presence of a phase transfer agent. U.S. Pat. No. 4,889,647 describes an organomolybdenum complex that is prepared by reacting a fatty oil, diethanolamine and a molybdenum source. An organomolybdenum that is prepared according to U.S. Pat. No. 4,889,647 and U.S. Pat. No. 5,412,130 is available from R. T. Vanderbilt Co. under the tradename Molyvan® 855.

Organomolybdenums that can be useful are described in U.S. Pat. No. 5,137,647 that describes an organomolybdenum that is prepared by reacting an amine-amide with a molybdenum source, U.S. Pat. No. 4,990,271 that describes a molybdenum hexacarbonyl dixanthogen, U.S. Pat. No. 4,164,473 that describes an organomolybdenum that is prepared by reacting a hydrocarbyl substituted hydroxy alkylated amine with a molybdenum source, and U.S. Pat. No. 2,805,997 that describes alkyl esters of molybdic acid.

All of the above patents relating to organomolybdenum compounds are hereby fully incorporated by reference.

The organomolybdenum additive that is added to the magnetorheological fluid preferably is in a liquid state at ambient room temperature and does not contain any particles above molecular size.

The various organothiophosphorus additives that can be utilized can have the formula

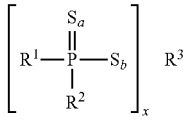

wherein $R^1$ and $R^2$ each individually have a structure represented by:

$$Y—(C)(R^4)(R^5))_n—O_w—$$

wherein Y is hydrogen or a functional group—containing moiety such as an amino, amido, imido, carboxyl, hydroxyl, carbonyl, oxo or aryl;

n is an integer from 2 to 17 such that $C(R^4)(R^5)$ is a divalent group having a structure such as a straight-chained aliphatic, branched aliphatic, heterocyclic, or aromatic ring;

$R^4$ and $R^5$ can each individually be hydrogen, alkyl or alkoxy; and w is 0 or 1.

A detailed description of such organothiophosphorus compounds are set forth in U.S. Pat. No. 5,683,615, and is hereby fully incorporated by reference.

Other suitable additives include those discussed in U.S. Pat. Nos. 7,217,372; 6,203,717; 5,906,676; 5,705,085; and 5,683,615, all hereby fully incorporated by reference.

The total amount of the one or more organomolybdenum additives and the one or more organothiophosphorus additives is generally from about 0.1 to about 3.0 and preferably from about 0.2 to about 2.0 parts by weight per every 100 total parts by weight of the MR fluid.

The following examples serve to illustrate, but not to limit the aspects of the present invention.

Table 1 shows the durability performance in one particular device configuration of two formulations prepared according to the present invention, as well as two formulations utilizing only one type of iron. In the table, Fe-300 is the softer iron particles ($H_v$ 300), and "FE-1050" ($H_v$ 1050), "Fe-680" ($H_v$ 680), and "Fe-550" ($H_v$ 550) are the harder iron particles. All fluids were made using the same oils and additives in the formulation with 26% total iron by volume. The base fluid was a commercially available fluid sold as MRF-132DG by LORD Corporation, Cary, N.C. IUT, or in-use thickening, an increase in the off-state damper force, is caused when the iron particles are degraded to the point of forming a significant fraction of particles smaller than 1 micron in diameter. Rod seal leakage is caused by excessive wear of the iron particles on the seal materials. The data show that 10% of harder iron significantly extended the lifetime of the fluid and prevented IUT. Fluid with 20% iron also extended the lifetime of the fluid for IUT but caused wear leading to failure of the rod seals.

TABLE 1

Comparison of Durability Results (M means 1 million)

| Iron Type | Damper Durability Result |
|---|---|
| Control A - 100% Fe-300 (soft) | Failed with IUT at 1.7M cycles (avg of 10 dampers) |
| Control B - 100% Fe-1050 (hard) | Failed with rod seal leakage (no IUT) at 1.25M, 1.5M cycles (2 dampers) |
| Example 1 - 90/10 Fe-300/Fe-1050 | Passed at 2.32M and 2.5M cycles (2 dampers) |
| Example 2 - 80/20 Fe-300/Fe-1050 | Failed with rod seal leakage (no IUT) at 2.0M cycles (2 dampers) |
| Example 3 - 90/10 Fe-300/Fe-680 | Passed at 2M cycles |
| Example 4 - 90/10 Fe-300/Fe-550 | Passed at 2M cycles |

Durability tests for fluids of the present invention were performed in an automotive linear damper comprised of a metal housing and an interior piston in which was located the magnetic gap. A device such as the MagneRide™ damper produced by BWI Group is a preferred test device. The device was mechanically exercised using a sine-on-sine excitation profile, with frequency and amplitude typical of those expected to be encountered in normal device operation, and with the device in the "on" state during this excitation. At periodic intervals, the excitation was paused and the force output of the device was tested in its "off" (magnetically deactivated) state. The fluid durability was considered acceptable if the off-state force was within about 50% of its original value.

As apparent from the above table, whether the iron particles were hard or soft, failure readily occurred early into the test program.

Examples 1 and 2 of the present invention that respectively utilized 10% and 20% by weight of the hard iron readily passed 2 M cycles. Similar to Example 1, Examples 3 and 4 readily passed the test at 2 M cycles.

Table 2 shows the relationship between device improvements and fluid durability. In a standard device, water atomized iron powder with a hardness of $H_v$ 400 caused early failure due to abrasion of the device. A carbonyl iron powder of $H_v$ 250 was degraded by the device and also caused wear. By using a powder blend containing both hard and soft iron powders, the correct balance of properties was achieved and the unit passed the durability test with no significant device or powder wear (Ex. 5).

TABLE 2

| Iron Type | Device Type | Durability Result |
|---|---|---|
| Control C - Water atomized iron ($H_v$ 400)(soft) | Standard | Failed with device wear |
| Control D - Reduced carbonyl iron ($H_v$ 250)(soft) | Standard | Failed with device wear and iron particle degradation |
| Example 5 - 60/40 Fe-300/Fe-680 | Modified | Passed, minimal device wear and no iron particle degradation |

Once again, the soft iron failed the fluid durability test whereas example 5 readily passed with minimal device wear and no iron particle degradation.

While in accordance with the patent statutes the best mode and preferred embodiment have been set forth, the scope of the invention is not intended to be limited thereto, but only by the scope of the attached claims.

What is claimed is:

1. A magnetorheological fluid, comprising:

a blend of two classes of magnetically responsive particles wherein one class is relatively hard and has a mean diameter particle range of about 1 micron to about 150 microns and the other class is relatively soft and has a mean diameter particle range of about 1 micron to about 100 microns, and wherein the hard particles comprise iron alloy particles, and wherein the hard particles are present in an amount of about 5 percent to about 50 percent by weight based on the total weight of the two classes of magnetically responsive particles and said fluid is free of fluorocarbons.

2. The magnetorheological fluid of claim 1, wherein the soft particles have a Vickers hardness of less than 400 $H_v$ and wherein the hard particles have a Vickers hardness of about 550 to about 1100 $H_v$.

3. The magnetorheological fluid of claim 2, wherein the magnetorheological fluid further comprises a hydrocarbon carrier fluid and optionally a suspension aid.

4. The magnetorheological fluid of claim 3, wherein the amount of said hard particles is from about 5% to about 30% by weight and the amount of said soft particles is from about 70% to about 95% by weight based upon the total weight of said hard and said soft particles.

5. The magnetorheological fluid of claim 4, wherein the amount of said hard particles is from about 10% to about 20% by weight and the amount of said soft particles is from about 80% to about 90% by weight based upon the total weight of said hard and soft particles; and wherein the total amount of said hard and soft iron particles is from about 50 parts to about 90 parts by weight per 100 total parts by weight of said carrier fluid.

6. The magnetorheological fluid of claim 5, wherein the total amount of said hard and soft iron particles is from about 60 parts by weight to about 89 parts by weight per 100 parts by weight of said carrier fluid; wherein the mean diameter of said hard particles is from about 2 to about 10 microns and wherein the mean diameter of said soft particles is from about 2 to about 8 microns.

7. The magnetorheological fluid of claim 1, wherein the composition further includes an organomolybdenum additive or an organothiophosphorus additive, or a combination thereof.

8. The magnetorheological fluid of claim 5, wherein the composition further includes an organomolybdenum additive or an organothiophosphorus additive, or a combination thereof; and wherein said magnetorheological fluid has a durability of at least 2.0 million cycles in an automotive linear damper.

9. The magnetorheological fluid of claim 2, wherein the soft particles have a Vickers hardness from about 50 to about 300 $H_v$, and when the hard particles have a Vickers hardness of about 600 to about 1050 H.

10. A method for forming a magnetorheological fluid, comprising the step of:

blending hard magnetically responsive particles and soft magnetically responsive particles with a carrier fluid, said magnetorheological fluid being free of fluorocarbons, wherein said hard particles have a mean diameter particle range of 1 micron to 150 microns and the soft particles have a mean diameter particle range of 1 micron to 100 microns, and the hard particles comprise iron alloy particles, and wherein the hard particles are present in an amount of about 5 percent to about 50 percent by weight based on the total weight of the two classes of magnetically responsive particles.

11. The method according to claim 10, wherein the soft particles have a Vickers hardness of less than 400 $H_v$, and wherein the hard particles have a Vickers hardness of about 550 to about 1100 $H_v$.

12. The method according to claim 11, wherein the amount of said hard particles is from about 5% to about 30% by weight and the amount of said soft particles is from about 70% to about 95% by weight based upon the total weight of said hard and said soft particles.

13. The method according to claim 12, wherein the amount of said hard particles is from about 10% to about 20% by weight and the amount of said soft particles is from about 80% to 90% by weight based upon the total weight of said hard and soft particles; and wherein the amount of said hard and soft iron particles is from about 50 parts to about 90 parts by weight per 100 total parts by weight of said carrier fluid.

14. The method according to claim 13, wherein the soft particles have a Vickers hardness from about 50 to about 300 $H_v$, and when the hard particles have a Vickers hardness of about 600 to about 1050 $H_v$.

15. The method according to claim 14, wherein the amount of said hard and soft iron particles is from about 60 parts by weight to about 89 parts by weight per 100 parts by weight of said carrier fluid; wherein the mean diameter of said hard particles is from about 2 to about 10 microns and wherein the mean diameter of said soft particles is from about 2 to about 8 microns.

16. The method according to claim 15, wherein the composition further includes an organomolybdenum additive or an organothiophosphorus additive, or a combination thereof.

* * * * *